US010724264B2

(12) United States Patent
Clark et al.

(10) Patent No.: US 10,724,264 B2
(45) Date of Patent: Jul. 28, 2020

(54) INTERMITTENT LOCKING DOOR MECHANISM

(71) Applicants: John Clark, Huntington Beach, CA (US); Mark Knight, Venice, CA (US); Adrian Alfaro, Menifee, CA (US)

(72) Inventors: John Clark, Huntington Beach, CA (US); Mark Knight, Venice, CA (US); Adrian Alfaro, Menifee, CA (US)

(73) Assignee: Sundance Spas, Inc., Chino, CA (US)

( * ) Notice: Subject to any disclaimer, the term of this patent is extended or adjusted under 35 U.S.C. 154(b) by 0 days.

(21) Appl. No.: 15/351,915

(22) Filed: Nov. 15, 2016

(65) Prior Publication Data

US 2017/0138077 A1 May 18, 2017

Related U.S. Application Data

(60) Provisional application No. 62/256,978, filed on Nov. 18, 2015.

(51) Int. Cl.

| | |
|---|---|
| ***E05D 7/10*** | (2006.01) |
| ***E04H 4/14*** | (2006.01) |
| ***E05D 1/06*** | (2006.01) |

(52) U.S. Cl.

CPC ..... *E04H 4/14* (2013.01); *E05D 1/06* (2013.01); *E05D 7/1066* (2013.01)

(58) Field of Classification Search

CPC ..... A47K 13/12; E04H 4/14; E05D 1/00–06; E05D 2007/0081; E05D 7/1066; E05D 7/1072; E05D 2007/128; A61H 33/6005; A61H 33/0087–0091

USPC ..... 16/265–268, 271; 220/821, 842, 845, 220/848; 4/496, 538–595, 541.1–541.5

See application file for complete search history.

(56) References Cited

U.S. PATENT DOCUMENTS

| | | | | |
|---|---|---|---|---|
| 2,263,946 | A | 11/1941 | Fletcher | |
| 2,572,463 | A | 10/1951 | Fine | |
| 4,233,694 | A | 11/1980 | Janosko et al. | |
| 4,236,259 | A | 12/1980 | Wendt | |
| 4,696,412 | A | 9/1987 | McGowan et al. | |
| 5,048,715 | A | 9/1991 | Wolff | |
| 5,144,720 | A | 9/1992 | Aihara et al. | |
| 5,210,906 | A | 5/1993 | Aihara et al. | |
| 5,761,849 | A * | 6/1998 | Tokuno | B60J 5/101 16/268 |
| 6,175,970 | B1 | 1/2001 | Pinciaro | |

(Continued)

FOREIGN PATENT DOCUMENTS

| | | | |
|---|---|---|---|
| EP | 0247756 | A1 | 12/1987 |
| JP | 2010280429 | A | 12/2010 |

OTHER PUBLICATIONS

IPRP re PCT/US2016/062444.

*Primary Examiner* — David P Angwin
*Assistant Examiner* — Nicholas A Ros
(74) *Attorney, Agent, or Firm* — The Webb Law Firm

(57) ABSTRACT

A spa tub system comprising a spa tub and at least one compartment integrated into the frame of the spa tub. The compartment includes a hatch which is attached to the compartment using a hinge assembly. The hinge assembly includes a bearing trough, a bearing cam, and a cam stop. The hatch is pivoted to open and close and can open to a predefined angle. At this predefined angle, the hatch cannot be removed. When the hatch is pivoted to a pivot angle less than the predefined angle, the hatch can be removed.

15 Claims, 11 Drawing Sheets

(56) References Cited

U.S. PATENT DOCUMENTS

| | | | | |
|---|---|---|---|---|
| 6,513,195 | B2 * | 2/2003 | Haase | A61G 11/00 16/266 |
| 6,584,624 | B2 * | 7/2003 | Horwood | E04H 4/0037 4/506 |
| 7,093,320 | B2 | 8/2006 | Tager | |
| 7,284,735 | B1 | 10/2007 | Khosropour et al. | |
| 7,386,896 | B2 | 6/2008 | Spicer | |
| 7,694,356 | B2 | 4/2010 | Bouiss | |
| 7,784,120 | B2 * | 8/2010 | Spicer | A61H 33/0087 4/541.1 |
| 8,727,165 | B2 * | 5/2014 | Nolan | B65D 11/18 16/246 |
| 8,869,866 | B2 * | 10/2014 | Bauman | G06F 3/1423 160/135 |
| 2005/0146255 | A1 | 7/2005 | Sabo et al. | |
| 2005/0155147 | A1 * | 7/2005 | Trepanier | A47K 3/001 4/630 |
| 2007/0226891 | A1 | 10/2007 | Pflueger | |
| 2007/0240257 | A1 | 10/2007 | Ignarra et al. | |
| 2008/0313796 | A1 * | 12/2008 | Wendt | A47K 13/12 4/234 |
| 2012/0061411 | A1 | 3/2012 | Singh | |
| 2015/0275559 | A1 | 10/2015 | Kalinowski | |

* cited by examiner

FIG. 4C
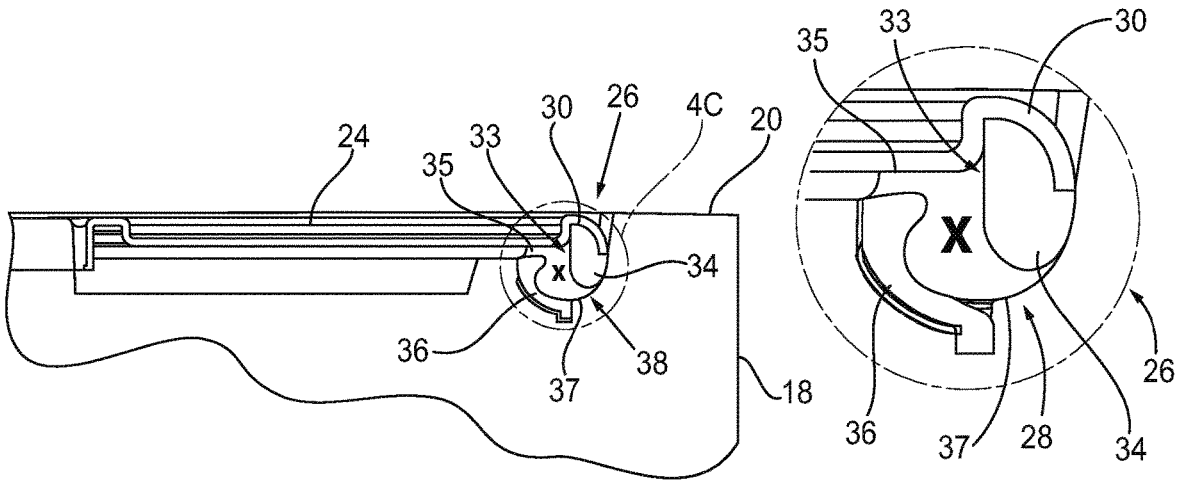
FIG. 4A
FIG. 4D
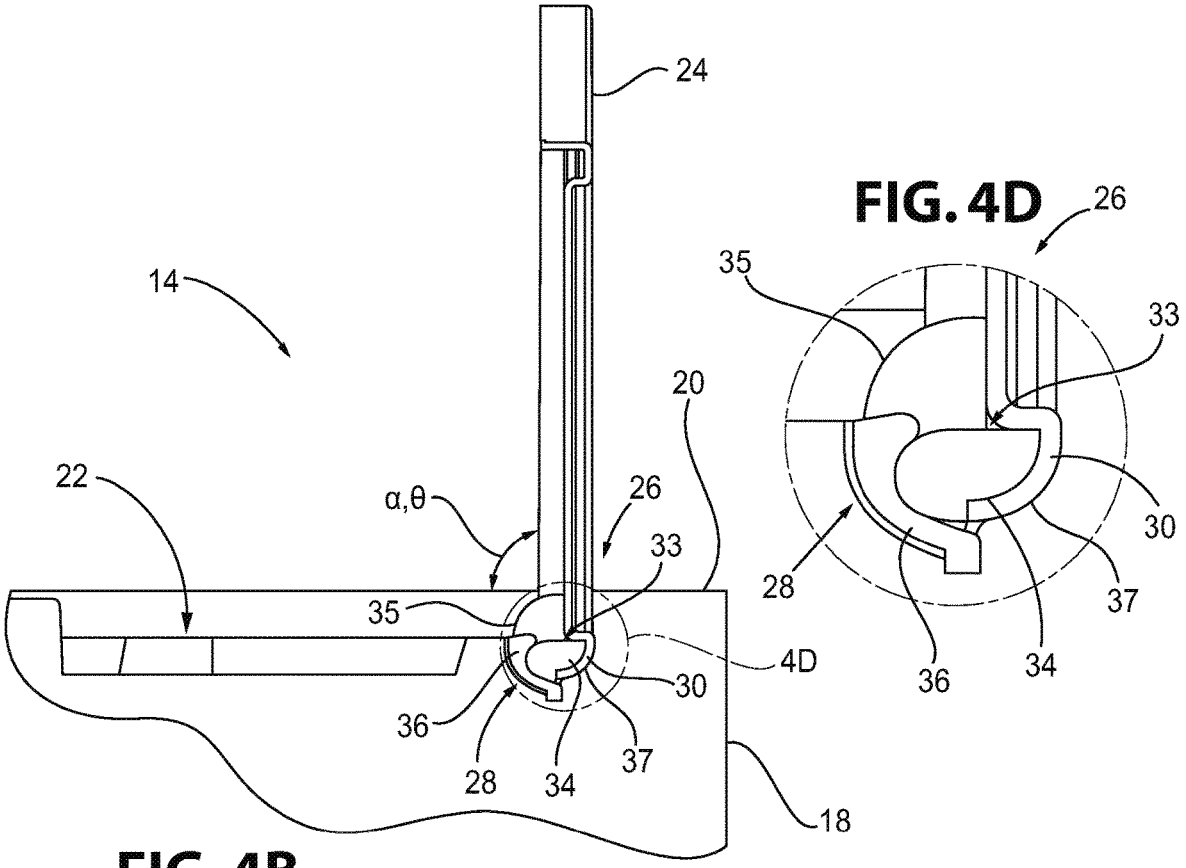
FIG. 4B

INTERMITTENT LOCKING DOOR MECHANISM

CROSS REFERENCE TO RELATED APPLICATIONS

This application claims benefit of priority from U.S. Provisional Patent Application No. 62/256,978, filed Nov. 18, 2015, which is incorporated herein by reference in its entirety.

BACKGROUND OF THE INVENTION

Field of the Invention

The present invention relates to a spa tub system that includes a spa tub with at least one compartment integrated into a frame of the spa tub, the compartment utilizing a hinge design with an intermittent locking door mechanism.

Description of Related Art

Spa tubs typically include a tub portion set within a frame. In some designs, the frame includes a deck portion, which is an extended floorlike surface.

It is common for users of a spa tub to enjoy the spa tub while consuming hot/cold beverages. In order to keep beverages hot/cold, an insulated container is often used, and in these prior art systems, an attachment is utilized to keep the insulated container close to the users of the spa tub, such as attaching an insulated container to the side of a spa tub. These insulated containers can be cumbersome to use and affect the appearance of the spa tub, as they are not an integrated part of the spa tub.

SUMMARY OF THE INVENTION

The spa tub system includes a spa tub having at least one compartment for storage, such as for storing hot/cold beverages. The spa tub includes a tub, and a frame, and the compartment is built into the frame of the spa tub. The compartment includes a storage space and a hatch. The compartment also includes a drain. The hatch is attached to the compartment using a hinge. A hinge assembly includes a carrier structure and a hinge. The carrier structure includes a bearing trough, a locking cam, and a cam stop. The hinge of the hatch engages the locking cam of the carrier structure to affix the hatch to the compartment. The bearing trough is not mechanically connected to the hatch but allows the hatch to swing open and closed. When the hatch is pivoted open to a pivot angle equal to a predefined angle, the cam stop prevents the hatch from opening any further and prevents the hatch from being removed. When the hatch is closed or has a pivot angle less than the predefined angle, the hatch is removable.

The hatch of the spa tub system may include a hinge assembly that affixes the hatch to the at least one compartment. The hinge assembly includes a carrier structure including a bearing trough, a bearing cam, and a cam stop. The hinge engages the bearing cam of the carrier structure. The bearing cam includes a locking cam and a cam guide. When the hatch is pivoted open to a predefined angle, the cam stop prevents the hatch from opening any further and prevents the hatch from being removed. When the hatch is closed or pivoted open to an angle less than the predefined angle, the hatch is removable. The bearing trough may include a cylindrical section wherein the bearing cam rests on the cylindrical section when the hatch is pivoted open. The compartment may be configured as an insulated container including an insulating material. The hinge may be an integral part of the hatch. The predefined angle may be 90 degrees.

Alternatively, the hinge assembly includes a bearing connected to a bearing post, a bearing trough and a notched keyway in a bottom portion of the bearing trough. The notched keyway has a first portion having a first width and a second portion have a second width. The first width is wider than the second width, and is configured to receive the bearing. The notched keyway includes a first stop at a first end of the notched keywatch, and a second stop at a second end of the notched keyway. The bearing post comprises a stop-portion. The stop-portion has a diameter or width less than the second width. The stop-portion coacts with the first stop when the hinge assembly is fully moved in a first direction. The stop-portion coacts with the second stop when the hinge assembly is fully moved in a second direction. The hinge assembly coacts with a hatch in a manner that the bearing trough coacts with the hatch. The bearing post coacts with a nut, wherein the nut coacts with a spa tub. The spa tub includes a compartment, and the compartment includes a drain. The hatch is configured to cover the compartment. When the hatch is in an open position, the stop-position of the bearing post coacts with the first stop of the notched keyway wherein the bearing coacts with the second position of the bearing trough to prevent the hatch from being removed. The notched keyway also includes a third portion having a third width that is more narrow than the first width. When the hatch is in a closed position, the bearing post coacts with the second stop of the notched keyway wherein the bearing coacts with the third portion of the bearing trough to prevent the hatch from being removed. When the hatch is an intermediate position, the bearing is positioned over the first portion of the notched keyway wherein the hatch can be removed and the bearing can move through the first portion of the notched keyway. The bearing trough can include a rib, and the hatch can include a recess configured to receive the rib. The bearing trough can be mechanically fastened to the hatch. The spa tub includes a spa trough configured to receive the bearing trough, wherein the bearing post coacts with the spa tube in the spa trough.

BRIEF DESCRIPTION OF THE DRAWINGS

FIG. 4A is a side elevation view of a compartment with a hatch in a closed position.

FIG. 4B is a side elevation view of the compartment shown in FIG. 4A with the hatch in an open position.

FIG. 4C is an enlarged view of 4C shown in FIG. 4A.

FIG. 4D is an enlarged view of 4D shown in FIG. 4B.

DETAILED DESCRIPTION OF THE INVENTION

It will be apparent to those skilled in the art that many uses and design variations are possible for the spa tub system disclosed herein. The following detailed discussion of various alternative and preferred aspects will illustrate general principles of the invention, but other aspects and variations will be apparent to those skilled in the art given the benefit of this disclosure.

Figure 1A:
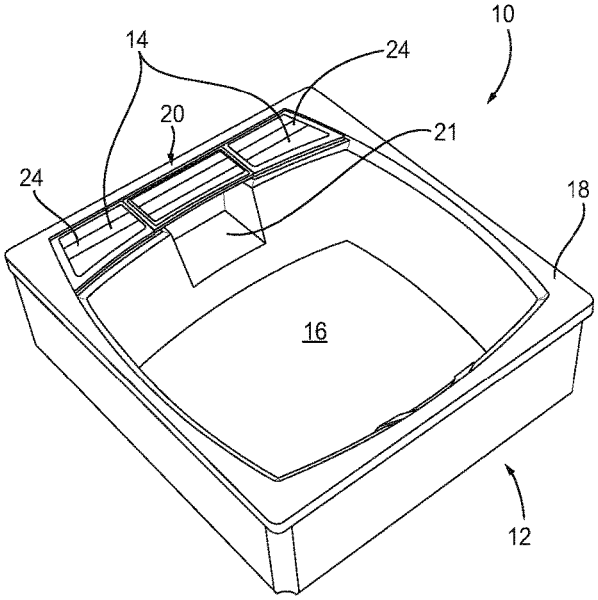
FIG. 1A is a top perspective view of a spa tub system with a hatch in a closed position.
Figure 1B:
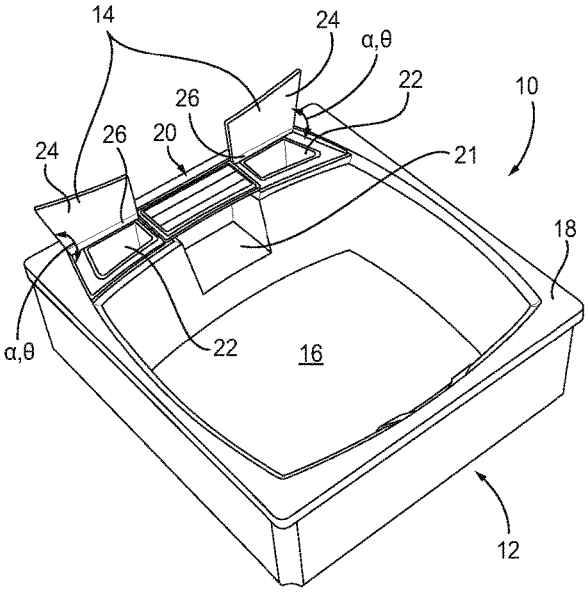
FIG. 1B is a top perspective view of a spa tub system with a hatch in an open position showing a first embodiment including a carrier structure and hinge made in accordance with the present invention.

Referring to FIGS. 1A-1B a spa tub system (10) includes a spa tub (12) and at least one compartment (14), and in the aspect illustrated in FIGS. 1A-1B, two compartments (14). The spa tub (12) made in accordance with the present invention includes a tub (16), which fills with water and in which a user of the spa tub (12) sits or stands once the tub (16) is at least partially filled with water. The tub (16) sits in a frame (18) of the spa tub (12). In some aspects of the invention, the spa tub (12) includes a deck (20), which is an extended floorlike surface of the frame (18). In FIGS. 1A-1B, the deck (20) is level with a top of the tub (16). The deck (20) could be removable so as to expose a seat or step (21). The compartment (14) includes a storage space (22) and a hatch/door (24) (hereinafter "hatch"). In one aspect of the invention, the hatch (24) is attached to the compartment (14) using a hinge assembly (26). In this aspect, the hatch (24), when closed, is a part of a surface of the deck (20).

As shown in FIGS. 1A-1B, the compartment (14) is built into the frame (18) of the spa tub (12) so as to be an integrated part of the spa tub (12). In some aspects of the invention, the compartment (14) is built into the deck (20) of the frame (18), such that the storage space (22) is located below a surface of the deck (20).

The storage space (22) of the compartment (14) is configured to hold various items. In one aspect of the invention, the storage space is configured as an insulated container to hold ice, water, hot and cold beverages, and food. The storage space (22) may include a drain (23) to allow melted ice from the insulated container to drain to the outside (see FIG. 2). The storage space (22) may also be lined with insulation (25) so as to keep the temperature of the ice, beverages, and food hot/cold longer (see FIG. 2). In another aspect of the invention, the storage space (22) is configured to receive and hold any other item in storage desired by the user, such as miscellaneous equipment for the spa tub (12).

The hatch (24) of the compartment (14) covers the storage space (22), and, when closed, is flush with the surface of the frame (18) or the deck (20), into which the compartment (14) is built. In one aspect of the invention, the hatch (24) is attached to the compartment (14) by way of a hinge assembly (26), such that the hatch (24) pivots open and closed. However, any type of cover suitable to cover the storage space (22) may be used, such as a sliding door.

Referring to FIGS. 2-4D, in one aspect of the invention, the hinge assembly (26) includes a carrier structure (28) and a hinge (30). The hinge (30) is an integral part of the hatch (24). The carrier structure (28) includes a bearing trough (32), a bearing cam (33), and a cam stop (36). The bearing cam (33) includes a locking cam (34) and a cam guide (35).

Figure 2:
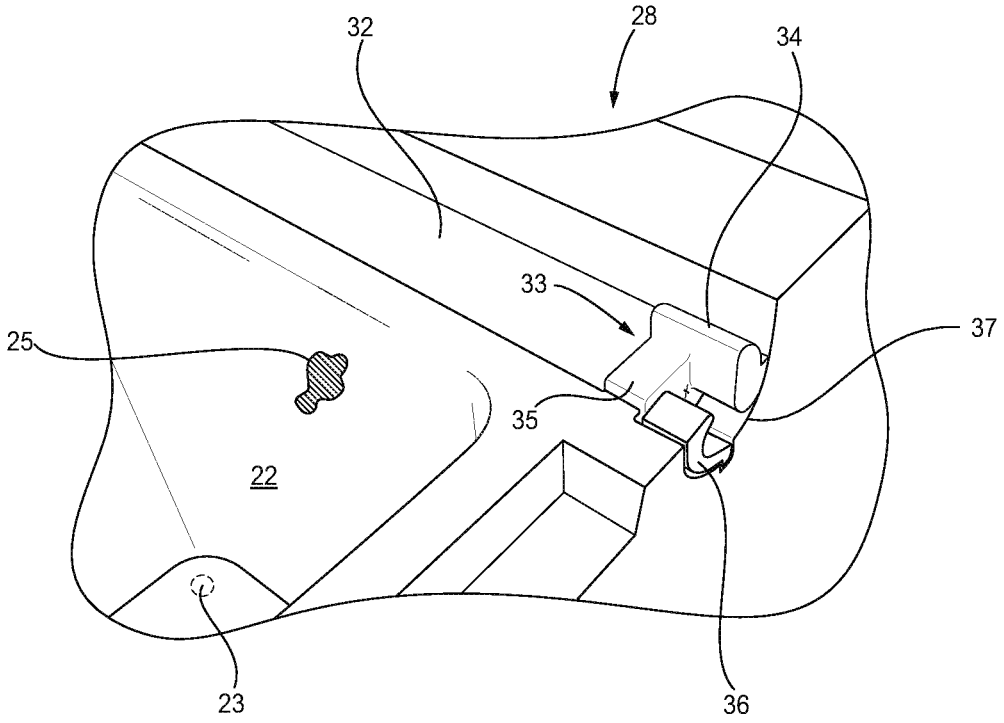
FIG. 2 is a partial top perspective view of a carrier structure shown in FIG. 1.
Figure 3:
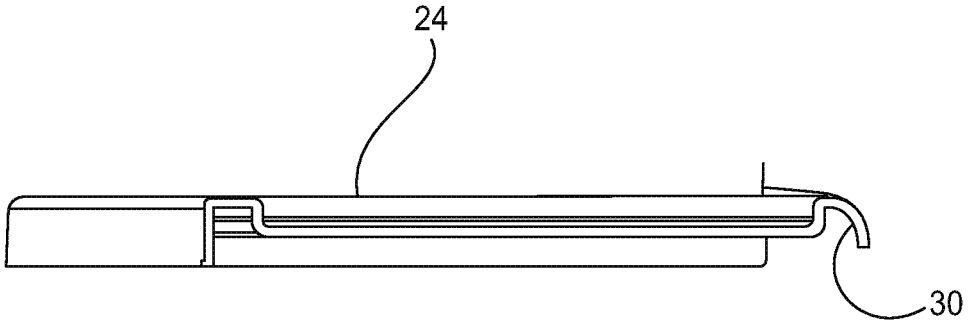
FIG. 3 is a side view of a hatch shown in FIG. 1.

FIG. 2 shows the carrier structure (28) in greater detail. The bearing trough (32) of the carrier structure (28) is a cylindrical section by which the bearing cam (33) rests when it carries the load of the hatch (24). The bearing trough (32) allows the hatch (24) to swing along a pivot axis (x) without a mechanical connection between the bearing trough (32), which includes a groove (37), and the hatch (24). A mechanical connection is any arrangement that uses mechanical fasteners, such as hinge pins. However, the bearing cam (33) may be attached to the hatch (24) or may be an integral part of the hatch (24), and can be removed from the bearing trough (32).

With continued reference to FIG. 2 and referring to FIGS. 4C and 4D, the bearing cam (33) includes a locking cam (34) connected to a cam guide (35). As the hatch (24) is opened, the bearing cam (33) is rotated about the pivot axis (x) in the clockwise direction, whereas when the hatch (24) is closed, the bearing cam (33) is rotated about the pivot axis (x) in the counter clockwise direction. Thus, as the hatch (24) is opened, the locking cam (34) and cam guide (35) rotate about the pivot axis (x) in the clockwise direction against the groove (37) until the locking cam (34) is prevented from rotating any further by engagement with the cam stop (36). During this rotation, the locking cam (34) is prevented from jostling (i.e., the locking cam (34) is kept against the groove (37) during rotation) by the cam guide (35), which rotates with the locking cam (34) and keeps the locking cam (34) against the groove (37).

Referring to FIGS. 4A-4D, to affix the hatch (24) to the carrier structure (28) (and ultimately the compartment (14)), the hinge (30), which is affixed to the hatch (24), engages the bearing cam (33) (and specifically the locking cam (34) of the bearing cam (33)). The bearing cam (33) allows the hatch (24) to pivot about the pivot axis (x), making a pivot angle ($\alpha$) relative to the hatch (24) being in a closed position (the closed position is shown in FIG. 4A), until the hatch (24) is opened to the point where the pivot angle ($\alpha$) is equal to a predefined angle ($\theta$), which is the maximum angle.

With continued reference to FIGS. 4A-4D, as the hatch (24) is opened from the position in FIG. 4A to 4B, the pivot angle ($\alpha$) increases from $\alpha=0°$ to $\alpha=0$. FIG. 4C shows a detailed view of the hinge assembly (26) when $\alpha=0°$ (the closed position), and FIG. 4D shows a detailed view of the hinge assembly (26) when $\alpha=\theta$ (the fully open position). To get from the position in FIG. 4C to the position in FIG. 4D, the bearing cam (33) pivots in a clockwise direction as the pivot angle ($\alpha$) increases. By the time the pivot angle is equal to the predefined angle ($\theta$), the locking cam (34) of the bearing cam (33) has pivoted to the point shown in FIG. 4D where the locking cam (34) is engaged by the cam stop (36), which prevents any further opening of the hatch (24) and prevents the removal of the hatch (24), as explained in more detail below. In one non-limiting aspect of the invention, the predefined angle ($\theta$) is 90°.

Figure 5:
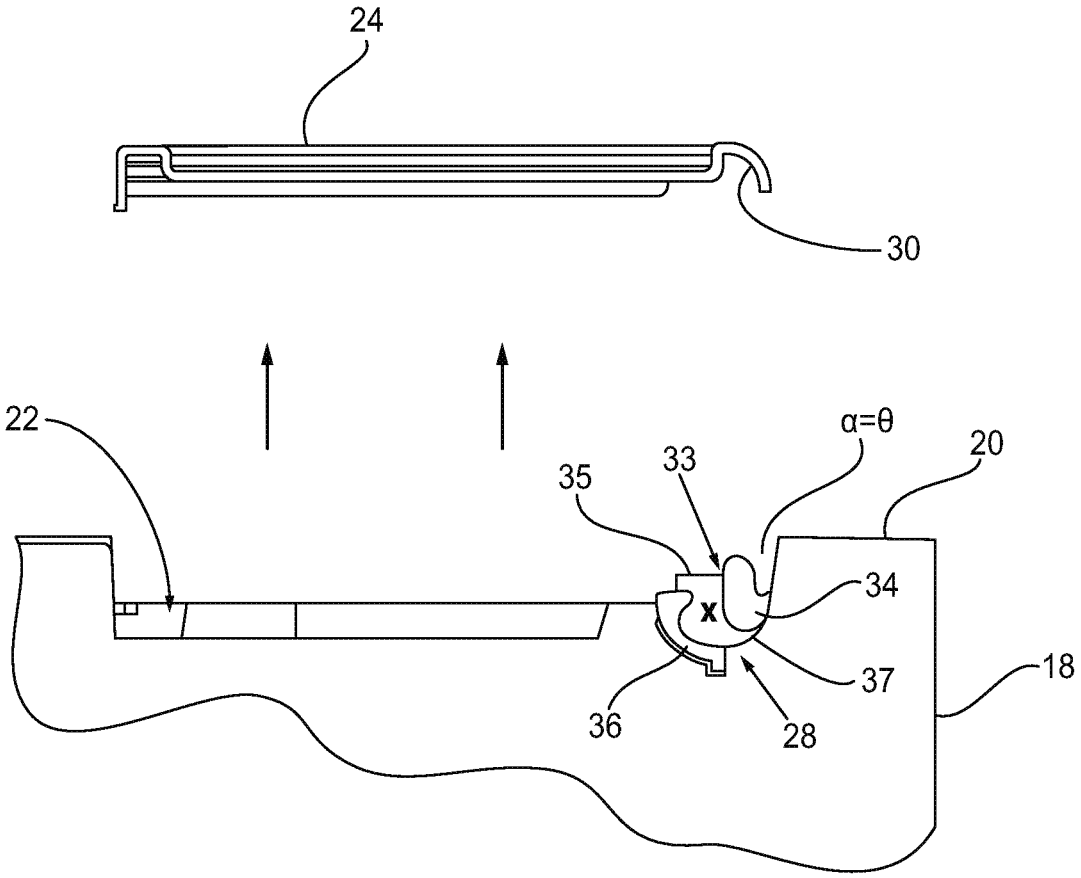
FIG. 5 is an exploded side elevation view of the compartment shown in FIG. 4A with the hatch removed.

Referring to FIGS. 4A-5, the hatch (24) is removable when the hatch (24) is at certain pivot angles ($\alpha$). For instance, as shown in FIG. 5, the hatch (24) in the closed position (shown by the dotted lines in FIG. 5) has a pivot angle ($\alpha$) of 0°, which is less than the maximum pivot angle, which is the predefined angle ($\theta$) (not shown in FIG. 5). The hatch (24), in this case, can be lifted off (see the vertically removed hatch (24) in FIG. 5) because the locking cam (34) is not engaged with the cam stop (36) so the hinge (30) is not prevented from lifting vertically.

Generally, the hatch (24) can be removed when the pivot angle (α) is less than the predefined angle (θ). The hatch (24) is removed by disengaging the hinge (30) from the bearing cam (33) (see FIG. 4A). However, when the hatch (24) is in its fully open position (i.e., the pivot angle (α) equals the predefined angle (θ)), the engaged locking cam (34) of the bearing cam (33) and cam stop (36) prevent the hinge (30) of the hatch (24) from being lifted up, preventing the hatch (24) from being removed off of the bearing cam (33) (see FIG. 4B). FIG. 4D shows in detail how the engagement of the locking cam (34) and the cam stop (36) prevents the hinge (30) from lifting vertically. In contrast, FIG. 4C shows the locking cam (34) and the cam stop (36) not engaged, and the hinge (30) is not prevented from lifting vertically.

This design allows the compartment (14) to be used practically by users of the spa tub (12). The configuration allows for easy removal of the lid to fill the compartment (14) with food, beverages, or other items, but prevents the lid from falling off when the lid is opened to its predefined angle (θ) by a user of the spa tub (12) retrieving a hot/cold beverage or other contents.

The hatch (24) may be affixed to the compartment (14) using the above-described hinge assembly (26); however, the hatch (24) may also be affixed to the compartment (14) using other arrangements as well, such as a prior art hinge. Further, the hinge assembly (26) described has utility beyond use in compartments (14) integrated into spa tubs (12), and has applications in other door/hatch arrangements.

Figure 6:
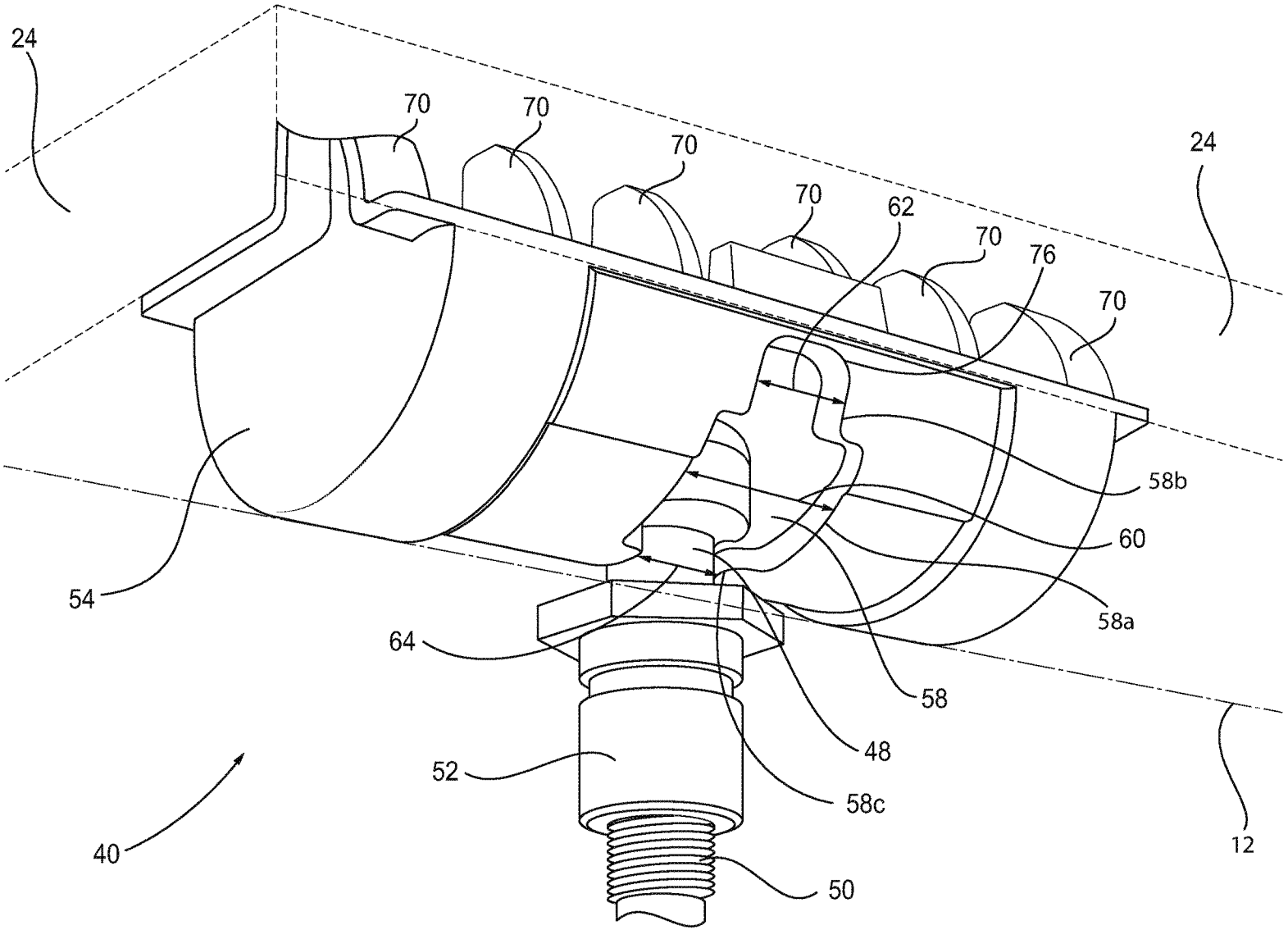
FIG. 6 is a bottom perspective view of a second embodiment of a hinge assembly including a bearing trough with a bearing, a bearing post, and a nut made in accordance with the present invention.
Figure 7:
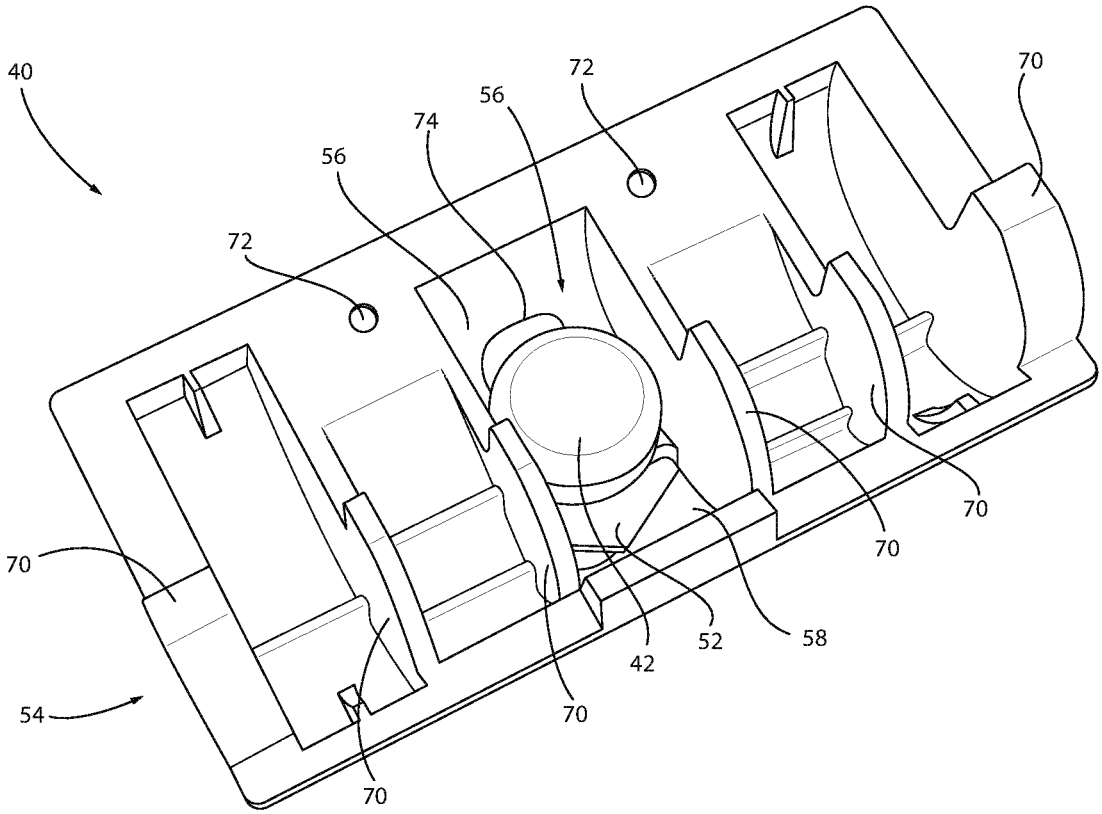
FIG. 7 is a top view of the bearing trough with the bearing shown in FIG. 6.
Figure 8:
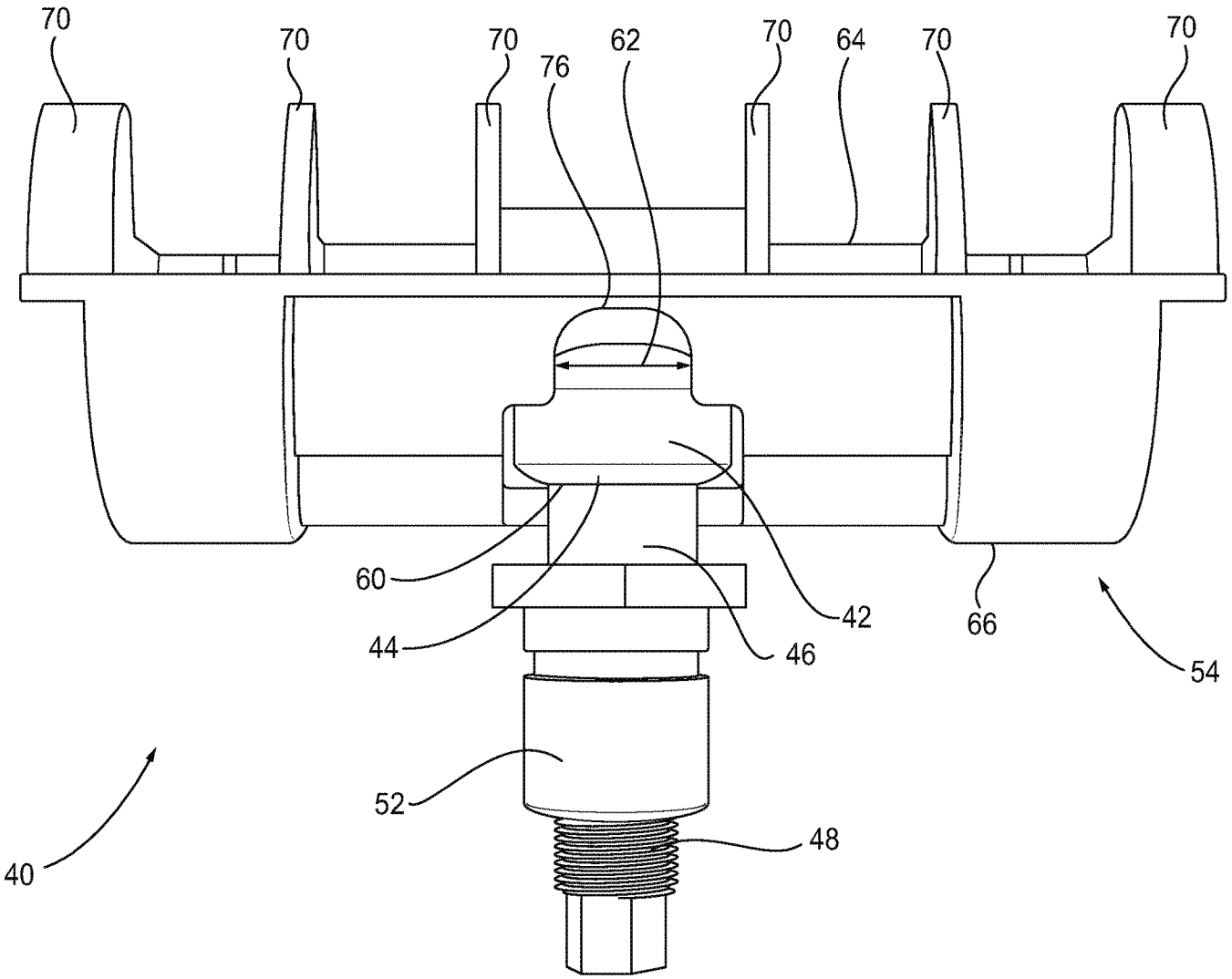
FIG. 8 is a side view of the bearing trough with the bearing, the bearing post, and the nut shown in FIG. 6.

Referring to FIGS. 6-11, a second embodiment of a hinge assembly (40) is shown. Referring to FIGS. 6-8, the hinge assembly (40) includes a bearing (42) connected to a bearing post (46) and a bearing trough (54). A notched keyway (58) is in a bottom portion of the bearing trough (54). The notched keyway (58) defines at least two different portions: a first portion (58*a*) and a second portion (58*b*). For example, the notched keyway (58) defines three different portions: a first portion (58*a*), a second portion (58*b*) and a third portion (58*c*). The first portion (58*a*) has a first width (60) and the second portion (58*b*) has a second width (62). If the notched keyway (58) has a third portion (58*c*), the third portion (58*c*) has a third width (64). The first width (60) is wider than the second width (62) or the third width (64). The second width (62) and the third width (64) may be approximately the same width. The first portion (58*a*) is configured to receive the bearing (42), while the second portion (58*b*) and (if present) third portion (58*c*) are configured to retain the bearing (42) in the bearing trough (54) because the second width (62) and (if present) third width (64) of the notched keyway (58) is more narrow than the diameter or width of the bearing (42). The bearing (42) can enter into the bearing trough (54) through the first portion (58*a*) of the bearing trough (54) while the bearing post (46) extends out of the bottom of the bearing trough (54). Once received into the bearing trough (54), the bearing (42) can move within the bearing trough (54). When the bearing (42) is positioned over the first portion (58*a*) of the bearing trough (54), the bearing (42) can be moved in and out from the bearing trough (54). When the bearing (42) is positioned over the second portion or third portion (58*c*) of the bearing trough (54), the bearing (42) is retained in the bearing trough (54).

The bearing trough (54) may include a rib (70) or a plurality of ribs (70). The rib (70) is configured to be received by a recess (78) in the hatch (24) to ensure proper alignment of the bearing trough (54) with the hatch (24), and the hatch (24) with the compartment (22). The hatch (24) is attached to the bearing trough (54) via a fastener, such as a screw, through a fastener hole (72).

Referring to FIGS. 6-9, the bearing post (46) includes a stop-portion (48) that is received within the notched keyway (58). The stop-portion (48) of the bearing post (46) may slide from the first portion (58*a*) into the second portion (58*b*) or third portion (58*c*) of the notched keyway (58) because the stop-portion (48) of the bearing post (46) has a diameter or width that is smaller than the first width (60) of the first portion (58*a*), the second width (62) of the second portion (58*b*) or the third width (64) of the third portion (58*c*) of the notched keyway (58). When the hinge is moved in the first direction, the stop-portion (48) of the bearing post (46) moves through the notched keyway (58) until it coacts with a first stop (74). The bearing post (46) is attached to the spa tub (12) with the surface of the spa shell being somewhere between the bearing (42) and the nut (52). When the stop-portion (48) of the bearing post (46) contacts the first stop (74), the bearing (42) is positioned over the second portion (58*b*) of the notched keyway (58). The bearing (42) is retained in the bearing trough (54) because the bearing is wider than the second width (62) of the second portion (58*b*). When the hinge is moved in a second direction, the stop-portion (48) of the bearing post (46) moves through the notched keyway (58) until it reaches a second stop (76) wherein the stop-portion (48) coacts with the second stop (76) to prevent further motion in the second direction, or until the hatch (24) rests on the spa tub (12). When the stop-portion (48) contacts the second stop (76), the bearing (42) is positioned over the first portion (58*a*) or the third portion (58*c*) of the notched keyway (58). If the bearing (42) is positioned over the third portion (58*c*) of the notched keyway (58), the bearing (42) is retained in the bearing trough (54) because the bearing (42) is wider than the third width (64). If the bearing (42) is positioned over the first portion (58*a*), the bearing (42) can move into and out of the bearing trough (54) because the first width (60) is wider than the bearing (42). In one embodiment, the first portion (58*a*) is positioned between the second portion (58*b*) and third position (58*c*).

Figure 9:
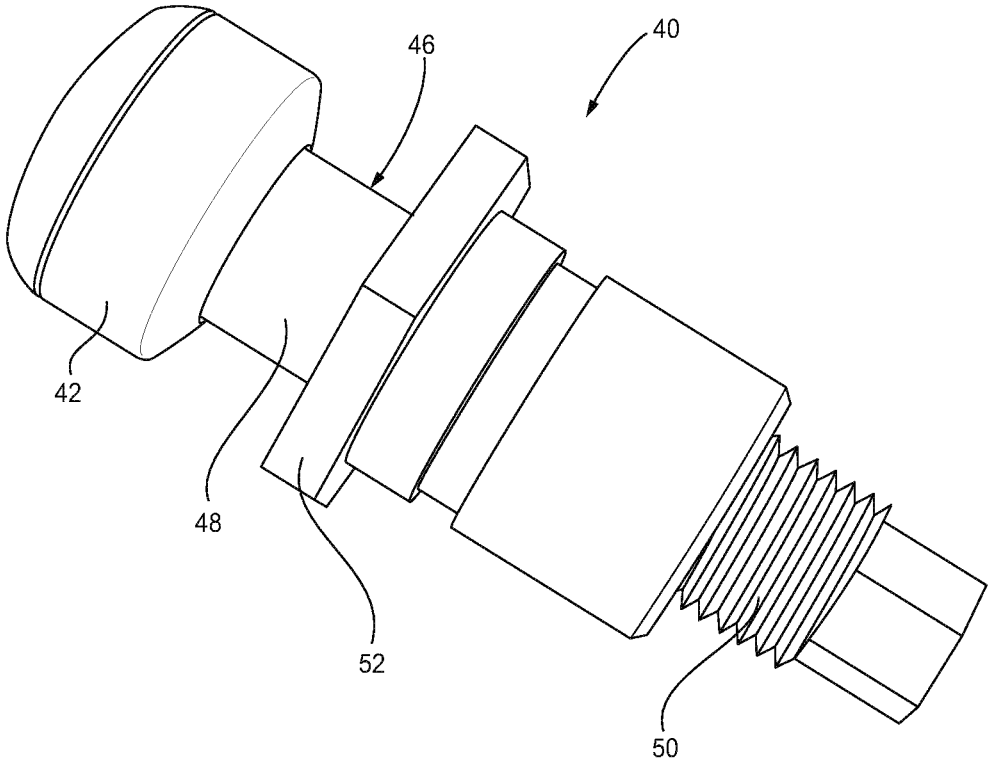
FIG. 9 is a side view of the bearing on the bearing post in the nut shown in FIG. 6.
Figure 10:
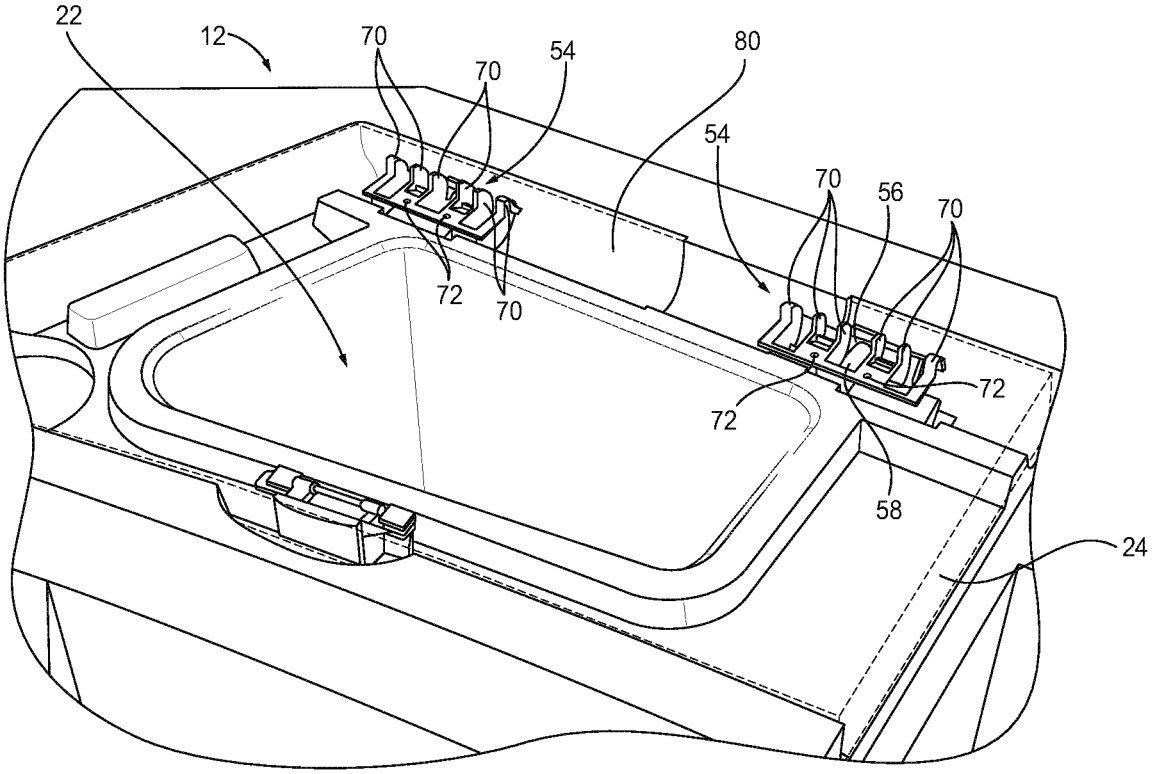
FIG. 10 is a top perspective view of a spa top with compartment and the hinge shown in FIG. 6.
Figure 11:
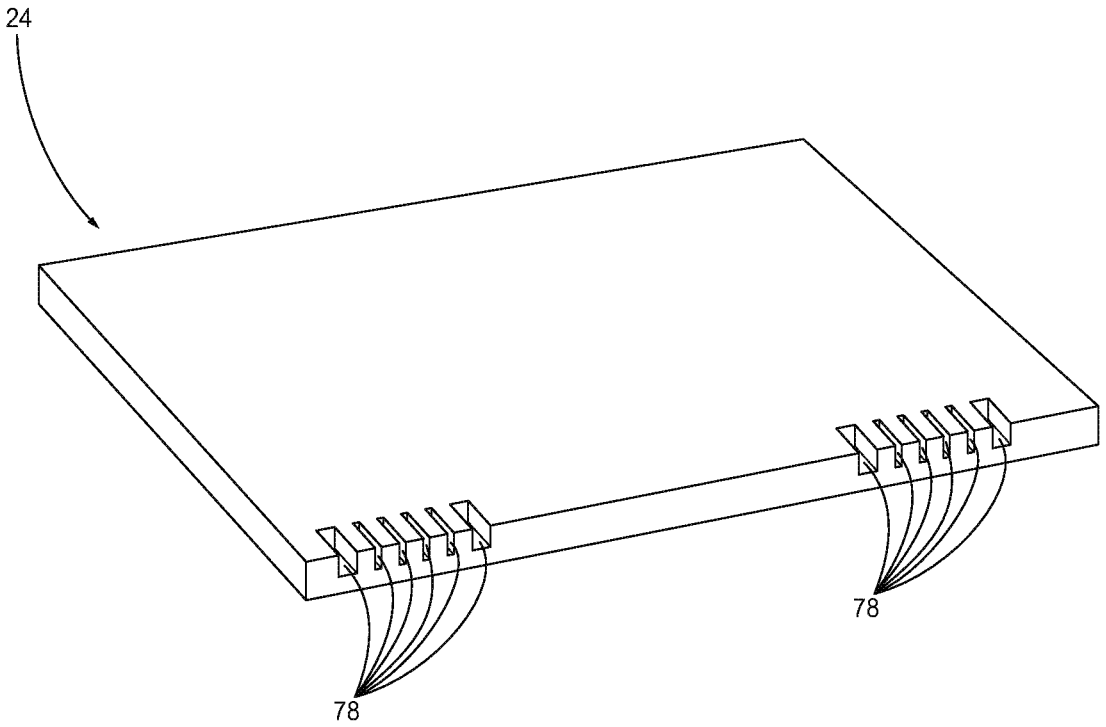
FIG. 11 is a bottom view of the hatch and recesses configured to receive ribs from the bearing trough shown in FIG. 6.

Referring to FIGS. 6, 8 and 9, the bearing post (46) may include a threaded portion (50) that is configured to be received by the nut (52). Referring to FIGS. 6 and 8-10, the nut (52) may coact with the spa tub (12) such as being attached to the spa tub (12). The nut (52) is received by the spa tub (12) in the spa tub trough (80).

The bearing trough (54) is configured to be affixed to the hatch (24). The bearing trough (54) may include a rib (70) or a plurality of ribs (70) that are received into a recess (78) (shown in FIG. 11) of a hatch (24) (shown in phantom in FIG. 10). In one embodiment, the bearing trough (54) is affixed to the hatch (24) by a mechanical fastener (not shown) through a fastener hole (72) in the bearing trough (54).

The hatch (24) and the bearing trough (54) can be placed onto a spa tub (12) in a spa trough (80). The hatch (24) is configured to cover a compartment (22) in the spa tub (12). The compartment (22) may have a drain (23). The bearing post (46) coacts with the spa tub (12) via a nut (52) incorporated into the spa tub (12) in the spa trough (80). The bearing (42) is attached to the bearing post (46), and passes through the first portion (58*a*) of the notched keyway (58). Once the bearing (42) is inside the bearing trough (54), the hatch (24) may move from a first open position, a second closed position and a third intermediate position. When the hatch (24) is in the first open position, the hatch (24) cannot be removed because the bearing (42) coacts with the second portion (58*b*) of the notched keyway (58) to prevent the hatch (24) from being removed. Alternatively, when the hatch (24) is in the second closed position, the hatch (24) cannot be removed because the bearing (42) coacts with the second portion (58*b*) of the notched keyway (58) to prevent the hatch (24) from being removed. In another alternative, when the hatch (24) is in the second closed position, the hatch (24) cannot be removed because the bearing (42) coacts with the third portion (58*c*) of the notched keyway (58) to prevent the hatch (24) from being removed.

On operation, the hatch (24) can be moved to a first open direction. The hatch (24) will continue to move in the first open direction until the stop-position (48) coacts with the first stop (74), thereby the hatch (24) would be fully opened. The hatch (24) can be moved from in the second close direction. The hatch (24) will continue in the second closed direction until the hatch (24) contacts the spa tub (12) or compartment (14) or until the stop-portion (48) contacts the second stop (76). The hatch (24) cannot be removed when in the fully opened position. If the bearing trough (54) does not have the third portion (58*c*) the hatch (24) can be removed when in the closed position. If the bearing trough (54) has a third portion (58*c*), the hatch (24) cannot be removed. The hatch (24) may be moved to an intermediate position between the fully opened and closed positions wherein the bearing (42) aligns with the first position of the bearing trough (54). At the intermediate position, the hatch (24) can be removed. The hatch (24) can be installed on the spa tub (12) by aligning the bearing (42) with the first position of the notched keyway (58) and passes the bearing (42) through the notched keyway (58).

While embodiments of a spa tub having a compartment with a hinge assembly are shown in the accompanying figures and described hereinabove in detail, other embodiments will be apparent to, and readily made by, those skilled in the art without departing from the scope and spirit of the invention. Accordingly, the foregoing description is intended to be illustrative rather than restrictive. The disclosure described hereinabove is defined by the appended claims and all changes to the disclosure that fall within the meaning and the range of equivalency of the claims are to be embraced within its scope.

The invention claimed is:

1. A hinge assembly comprising:

a bearing connected to a bearing post, the bearing having a width greater than a width of the bearing post; and a bearing trough comprising a cylindrical section having a longitudinal axis transverse to a longitudinal axis of the bearing post, the bearing trough comprising a notched keyway defined in a bottom portion thereof, the notched keyway comprising a first portion having a first width greater than the width of the bearing and a second portion having a second width less than the width of the bearing and greater than the width of the bearing post, the notched keyway defining a first stop at one end thereof and a second stop at an opposite end thereof, the second stop being defined within the second portion of the notched keyway, wherein the bearing trough is rotatable about the longitudinal axis thereof with respect to the bearing and the bearing post between a first position, in which the bearing coacts with the first stop and a second position in which the bearing coacts with the second stop, wherein the hinge assembly is configured to hingedly connect a hatch to a compartment, the bearing trough being configured to be connected to the hatch and the bearing being configured to be connected to the compartment, the first position of the bearing trough corresponding to a closed position of the hatch with respect to the compartment, the second position of the bearing trough corresponding to a fully open position of the hatch with respect to the compartment, wherein rotating the bearing trough between the first position and the second position causes the bearing post to pass through the notched keyway along a path between the first stop and the second stop of the notched keyway, and wherein a length of a portion of the path, where the bearing is removable from the bearing trough, is greater than a length of a portion of the path, where the bearing is retained by the bearing trough.

2. The hinge assembly according to claim 1, further comprising a nut, wherein the bearing post comprises a threaded portion configured to coact with the nut to connect the bearing and the bearing post to the compartment.

3. The hinge assembly according to claim 1, wherein the bearing post comprises a stop-portion having a diameter that is less than the second width of the second portion of the keyway.

4. The hinge assembly according to claim 1, wherein the notched keyway further comprises a third portion having a third width less than the width of the bearing and greater than the width of the bearing post, the first stop being defined within the third portion of the notched keyway, and wherein the third portion of the notched keyway coacts with the bearing to retain the bearing trough on the bearing when the bearing trough is in the first position such that the hatch is retained on the compartment when the hatch is in the closed position.

5. The hinge assembly according to claim 1, wherein the bearing trough comprises a rib configured to coact with a corresponding recess formed in the hatch.

6. The hinge assembly according to claim 1, wherein, when the bearing trough rotates with respect to the bearing and the bearing post between the first position in which the bearing coacts with the first stop and the second position in which the bearing coacts with the second stop, the bearing trough rotates 90 degrees.

7. The hinge assembly of claim 1, wherein the bearing comprises a circular cross section having a first diameter and an arcuate surface about a longitudinal axis thereof, and wherein the bearing post comprises a circular cross section having a second diameter and an arcuate surface about a longitudinal axis thereof, the first diameter being greater than the second diameter.

8. The hinge assembly according to claim 1, wherein the hatch and the compartment are disposed on a spa tub.

9. The hinge assembly according to claim 8, wherein the bearing trough is configured to be received in a corresponding trough defined in or adjacent to the compartment.

10. A compartment assembly, comprising:

a compartment;

a hatch; and a hinge assembly for hingedly connecting the hatch to the compartment, the hinge assembly comprising:

a bearing trough; and a bearing cooperating with the bearing trough for pivoting the hatch with respect to the compartment, wherein the hatch is rotatable with respect to the compartment between a closed position and a fully open position, wherein the bearing trough coacts with the bearing to retain the hatch on the compartment when the hatch is in the closed position and the fully open position, wherein the bearing trough coacts with the bearing such that the hatch is removable from the compartment when the hatch is rotated to an intermediate position between the closed position and the fully open position, and wherein, when the hatch rotates with respect to the compartment between the closed position and the fully open position, the hatch rotates in an arc of 90 degrees, in which a portion of the arc where the bearing is removable from the bearing trough such that the hatch is removable from the compartment, is longer than a portion of the arc where the bearing is retained in the bearing trough such that the hatch is retained on the compartment.

11. The compartment assembly according to claim 10, wherein the compartment assembly is configured to be disposed in a deck of a spa tub system.

12. The compartment assembly of claim 10, wherein the bearing comprises a circular cross section having a first diameter and an arcuate surface about a longitudinal axis thereof, and wherein the hinge assembly further comprises a bearing post connected to the bearing, the bearing post comprising a circular cross section having a second diameter and an arcuate surface about a longitudinal axis thereof, the first diameter being greater than the second diameter.

13. A compartment assembly comprising:

a compartment;

a hatch; and a hinge assembly for hingedly connecting the hatch to the compartment, the hinge assembly comprising:

a bearing connected to a bearing post disposed on one of the compartment and the hatch, the bearing having a width greater than a width of the bearing post; and a bearing trough comprising a cylindrical section having a longitudinal axis transverse to a longitudinal axis of the bearing post, disposed on the other of the compartment and the hatch, the bearing trough comprising a notched keyway defined in a bottom portion of the bearing trough, the notched keyway comprising a first portion having a first width greater than the width of the bearing, a second portion having a second width less than the width of the bearing and greater than the width of the bearing post, and a third portion having a third width less than the width of the bearing and greater than the width of the bearing post, the notched keyway defining a first stop at one end thereof and a second stop at an opposite end thereof, the first stop being defined within the third portion of the notched keyway, and the second stop being defined within the second portion of the notched keyway, wherein the bearing trough is rotatable about the longitudinal axis thereof and with respect to the bearing and the bearing post between a first position corresponding to a closed position of the hatch with respect to the compartment in which the bearing coacts with the first stop and a second position corresponding to a fully open position of the hatch with respect to the compartment in which the bearing coacts with the second stop, wherein rotating the bearing trough between the first position and the second position causes the bearing post to pass through the notched keyway along a path between the first stop and the second stop of the notched keyway, and wherein a length of a portion of the path, where the bearing is removable from the bearing trough, is greater than a length of a portion of the path, where the bearing is retained by the bearing trough.

14. The compartment assembly according to claim 13, wherein, when the bearing trough rotates with respect to the bearing and the bearing post between the first position in which the bearing coacts with the first stop and the second position in which the bearing coacts with the second stop, the bearing trough rotates 90 degrees.

15. The compartment assembly of claim 13, wherein the bearing of the hinge assembly comprises a circular cross section having a first diameter and an arcuate surface about a longitudinal axis thereof, and wherein the bearing post comprises a circular cross section having a second diameter and an arcuate surface about a longitudinal axis thereof, the first diameter being greater than the second diameter.

* * * * *